US008210239B2

(12) United States Patent
Toh et al.

(10) Patent No.: US 8,210,239 B2
(45) Date of Patent: Jul. 3, 2012

(54) CONTINUOUS CASTING METHOD OF MOLTEN METAL

(75) Inventors: Takehiko Toh, Tokyo (JP); Masahiro Tani, Tokyo (JP); Kazuhisa Tanaka, Tokyo (JP); Shinichi Fukunaga, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 398 days.

(21) Appl. No.: 12/516,061

(22) PCT Filed: Dec. 3, 2007

(86) PCT No.: PCT/JP2007/073731

§ 371 (c)(1),
(2), (4) Date: May 22, 2009

(87) PCT Pub. No.: WO2008/069329

PCT Pub. Date: Jun. 12, 2008

(65) Prior Publication Data

US 2010/0059197 A1 Mar. 11, 2010

(30) Foreign Application Priority Data

Dec. 5, 2006 (JP) ..... 2006-328273

(51) Int. Cl.
*B22D 11/10* (2006.01)
*B22D 11/115* (2006.01)

(52) U.S. Cl. ..... 164/489; 164/488; 164/468; 164/437

(58) Field of Classification Search ..... 164/437–439, 164/468, 488, 489, 502–504; 222/606
See application file for complete search history.

(56) References Cited

U.S. PATENT DOCUMENTS

| | | | | |
|---|---|---|---|---|
| 3,865,175 | A * | 2/1975 | Listhuber et al. | 164/489 |
| 3,991,815 | A * | 11/1976 | Fastner et al. | 164/437 |
| 6,336,496 | B1 * | 1/2002 | Asai et al. | 164/502 |

FOREIGN PATENT DOCUMENTS

| | | | |
|---|---|---|---|
| GB | 1379191 | A | 1/1975 |
| JP | 48-88029 | A | 11/1973 |
| JP | 50-145324 | A | 11/1975 |
| JP | 52-32824 | A | 3/1977 |
| JP | 10-166120 | A | 6/1998 |
| JP | 2000-280050 | A | 10/2000 |
| KR | 1999-012672 | U | 4/1999 |
| KR | 1999-0050906 | A | 7/1999 |

OTHER PUBLICATIONS

JPO machine translation of JP 2000-280050, Oct. 10, 2000.* English translation of Office Action which issued in corresponding Taiwanese patent application No. 96146041.
Korean Office Action dated Mar. 24, 2011 issued in corresponding Korean patent application No. 10-2009-7011511 (with English translation).

* cited by examiner

*Primary Examiner* — Jessica L Ward
*Assistant Examiner* — Kevin E Yoon
(74) *Attorney, Agent, or Firm* — Birch, Stewart, Kolasch & Birch, LLP

(57) ABSTRACT

A continuous casting method of molten metal using electromagnetic force to improve the cast slab surface properties and reduce the nonmetallic inclusions and bubbles trapped inside the cast slab is provided. An alternating current is run through an electromagnetic coil arranged around a casting mold so as to surround a casting space to control the meniscus shape to improve the cast slab surface properties. The discharge ports of a submerged entry nozzle are oriented upward and the direction of the discharge flow from the discharge ports is above the intersection of the casting mold short side and meniscus.

4 Claims, 6 Drawing Sheets

(a)

(b)

(a)

(b)

CONTINUOUS CASTING METHOD OF MOLTEN METAL

TECHNICAL FIELD

The present invention relates to a continuous casting method of molten metal, more particularly relates to an improvement of a flow of molten metal in a casting mold.

BACKGROUND ART

In a continuous casting method of molten metal, a casting mold having a casting space for forming a cast slab surrounded at four sides by water-cooled copper plates is used, molten metal is injected into the casting mold, the part of the molten metal contacting the casting mold solidifies to form a shell, the shell is pulled out from the bottom of the casting mold while growing, and the metal finally finishes solidifying whereupon a continuously cast slab is formed.

In continuous casting of a cast slab of a flat shape, the casting space in the casting mold also has a rectangular cross-section. The surfaces of the casting mold facing the long sides of the cross-sectional rectangular shape are called the "long side surfaces" while the surfaces of the casting mold facing the short sides of the rectangular shape are called the "short side surfaces". The molten metal is supplied through a submerged entry nozzle into the casting mold. The submerged entry nozzle is a closed bottom cylindrical shape. Near the bottom end of the submerged entry nozzle, discharge ports are formed oriented in two directions in the longitudinal direction of the casting space. The discharge ports discharge molten metal inside the casting mold. The discharge flow from the discharge ports of the submerged entry nozzle penetrates in the molten metal pool in the casting mold and strikes the casting mold short sides whereupon it is divided in an upward oriented flow and a downward oriented flow.

At the surface of the molten metal pool formed in the casting mold, continuous casting mold flux is supplied forming a layer. This is melted by the heat of the molten metal and flows into the gap between the casting mold and the shell to form a mold flux film there. This functions as a lubricant between the casting mold and shell. The casting mold constantly vibrates in the vertical direction (called "oscillation") to promote the inflow of the mold flux film and facilitate withdrawal of the cast slab. On the other hand, the cast slab surface is formed with relief shapes called "oscillation marks" due to the casting mold oscillation.

If arranging an electromagnetic coil around the casting mold having a current path surrounding the casting space and running an alternating current through this electromagnetic coil, a pinch force acts on the molten metal in the casting mold. Japanese Patent Publication (A) No. 52-32824 describes an invention making this electromagnetic force act near the meniscus of the molten metal and thereby causing the molten metal near the meniscus in the casting mold to receive force in a direction separating it from the casting mold wall and making the meniscus strongly bend and simultaneously enlarging the gap between the casting mold and the shell to thereby promote the inflow of powder, reduce oscillation marks, and improve the shape of the cast slab surface.

On the other hand, the thus acting electromagnetic force simultaneously forms an electromagnetic ally driven flow at the molten metal pool in the casting mold. The electromagnetic ally driven flow is formed at the center of the electromagnetic coil in the height direction heading from the shell to the center of the molten metal pool and is divided into the upward oriented flow and the downward oriented flow at the pool center. At a location corresponding to the top half of the electromagnetic coil, a circulating flow is formed comprised of an upward oriented flow at the pool center, an outwardly oriented flow at the meniscus part, and a downward oriented flow near the shell. At a location corresponding to the bottom half of the electromagnetic coil, a rotary flow is formed comprised of a downward oriented flow at the pool center, an outwardly oriented flow near the bottom end of the electromagnetic coil, and an upward oriented flow near the shell.

Japanese Patent Publication (A) No. 11-188460 describes, in an example of casting a billet having a circular or rectangular casting cross-section, a method of continuous casting arranging a molten metal injection nozzle having discharge ports opening in a downward oriented direction so that the discharge ports are positioned below the center of the electromagnetic coil and injecting molten metal into the casting mold from the discharge ports of the molten metal injection nozzle. In what is described in Japanese Patent Publication (A) No. 11-188460, due to this, the rotary flow flowing upward oriented at the center of the molten metal pool is not affected by the discharge flow from the molten metal injection nozzle, so it is considered that a cast slab superior in surface properties is cast.

The molten metal refined by oxygen for decarburization at a refining furnace contains free oxygen, so when transferring molten metal from the refining furnace to a ladle, a deoxidizing agent with a strong deoxidizing power is added into the molten metal to convert the free oxygen to oxides. The nonmetallic oxides formed mostly float up in the molten metal to be separated, but part remains floating in the molten metal and are transferred as is to the tundish. For this reason, the molten metal supplied from the tundish through the immersion nozzle to the inside of the casting mold includes nonmetallic inclusions. Further, to prevent the nonmetallic inclusions in the molten metal from sticking to the inside walls of the submerged entry nozzle, nonoxidizing gas is blown in the submerged entry nozzle. The blown nonoxidizing gas is entrained in the molten metal to become bubbles which move together with the molten metal. These nonmetallic inclusions and bubbles in the molten metal are supplied from the discharge ports of the submerged entry nozzle together with the discharge flow to the inside of the casting mold. If the nonmetallic inclusions and bubbles are entrained in the cast slab, they form quality defects, so it is preferable as much as possible to make them float up in the molten metal in the casting mold and have them absorbed by the continuous casting mold flux covering the meniscus for separation.

In recent continuous casting, the mold is made a vertical bending type provided with a vertical part directly under the meniscus to promote the flotation and separation of the nonmetallic inclusions and bubbles at the vertical part. Further, if the discharge flow from the discharge ports of the submerged entry nozzle strikes the casting mold short sides, then flows downward along the casting mold short sides too strongly, the nonmetallic inclusions and bubbles riding this flow will reach the deep parts of the cast slab and be entrained in the solidified cast slab.

DISCLOSURE OF THE INVENTION

By running an alternating current to an electromagnetic coil arranged around the casting mold so as to surround the casting space, it is possible to control the meniscus shape to improve the cast slab surface properties. However, as described in the above-mentioned Japanese Patent Publication (A) No. 11-188460, if arranging the molten metal injection nozzle having discharge ports opening in the downward oriented direction so that the discharge ports are positioned below the center of the electromagnetic coil for casting, the cast slab surface properties are improved, but the nonmetallic inclusions and bubbles trapped inside the cast slab cannot be sufficiently reduced.

The present invention has as its object the provision of a continuous casting method of molten metal using electromagnetic force to improve the cast slab surface properties and reduce the nonmetallic inclusions and bubbles trapped inside the cast slab.

In the case of using a submerged entry nozzle 5 having discharge ports 6 opening in the downward oriented direction described in Japanese Patent Publication (A) No. 11-188460 (FIG. 2(*c*)) of course and even in a submerged entry nozzle 5 having discharge ports 6 opening in the horizontal direction or, as shown in FIG. 2(*b*), in the somewhat upward oriented direction, it was learned that so long as the discharge flow 14 from the discharge ports 6 is discharged in a direction striking the short side shell 13 of the cast slab, nonmetallic inclusions and bubbles are trapped near the short side shell 13 which the discharge flow 14 strikes. Further, the discharge flow 14 from the discharge ports, as shown in FIG. 4(*c*) (*d*), spreads in the thickness direction of the cast slab the further from the discharge ports 6 and contacts the long side shell 12 at the two sides before striking the short sides. Further, it was learned that when the discharge flow 14 contacts the long side shell 12, the nonmetallic inclusions and bubbles are trapped at the long side shell 12 at those locations.

As opposed to this, as shown in FIG. 3, if running an alternating current through an electromagnetic coil 4 arranged around the casting mold 1 so as to surround the casting space 8 to control the meniscus shape to improve the cast slab surface properties and, as shown in FIG. 1(*a*), making the discharge ports 6 of the submerged entry nozzle 5 upward oriented and, further, making the direction of the discharge flow 14 from the discharge ports 6 head higher than the intersection A of the casting mold short side and meniscus, the discharge flow 14 will reach the meniscus 11 before striking the short side shell 13. As a result, the nonmetallic inclusions and bubbles in the discharge flow are absorbed by the continuous casting mold flux of the meniscus 11 at the parts of the meniscus reached. Further, the discharge flow 14 from the discharge ports 6 to the meniscus 11 receives the electromagnetic force due to the electromagnetic coil 4 and receives force from the long side shell toward the cast slab center, so the spread of the discharge flow in the cast slab thickness direction is suppressed and, as shown in FIG. 1(*b*) and FIG. 4(*a*) (*b*), the discharge flow 14 can reach the meniscus 11 without touching the long side shell 12. Therefore, it is possible to keep nonmetallic inclusions and bubbles from being trapped from the discharge flow 14 to the long side shell 12. As a result, electromagnetic force may be used to control the meniscus shape to improve the cast slab surface properties and simultaneously keep nonmetallic inclusions and bubbles from being trapped at the cast slab and a cast slab excellent in both surface properties and internal quality can be produced.

The present invention was made based on this discovery and has as its gist the following:

(1) A continuous casting method of molten metal injecting molten metal into a casting mold having a casting space of a rectangular cross-sectional shape through a submerged entry nozzle, arranging an electromagnetic coil having an electric current path surrounding the casting space around the casting mold, running an alternating current through this electromagnetic coil, and using said alternating current so that the molten metal near the meniscus in the casting mold receives force in a direction separating it from the casting mold wall while continuously casting the molten metal, said continuous casting method of molten metal characterized by forming a discharge flow discharged from discharge ports of molten metal provided at a front end of the submerged entry nozzle oriented upward from the horizontal toward the short sides of the casting mold and in that a direction of a center line of said discharge flow is oriented upward from an intersection of the casting mold short sides and meniscus.

(2) A continuous casting method of molten metal injecting molten metal into a casting mold having a casting space of a rectangular cross-sectional shape through a submerged entry nozzle, arranging an electromagnetic coil having an electric current path surrounding the casting space around the casting mold, running an alternating current through this electromagnetic coil, and using said alternating current so that the molten metal near the meniscus in the casting mold receives force in a direction separating it from the casting mold wall while continuously casting the molten metal, said continuous casting method of molten metal characterized by providing discharge ports of molten metal provided at a front end of the submerged entry nozzle oriented upward from the horizontal toward the short sides of the casting mold and in that a direction of a center line of said discharge ports is oriented upward from an intersection of the casting mold short sides and meniscus.

(3) A continuous casting method of molten metal as set forth in (1) or (2) characterized in that 0.8 of an angle between an opening direction X of said discharge ports and the horizontal direction is larger than an angle between a direction from the discharge port center C to the intersection A of the casting mold short side and meniscus and the horizontal direction.

(4) A continuous casting method of molten metal as set forth in (1) or (2) characterized in that a casting direction length of the electromagnetic coil 4 is made L and the center C of the discharge ports 6 is positioned above the bottom end of the electromagnetic coil 4 by more than ¼·L.

(5) A continuous casting method of molten metal as set forth in (1) or (2) characterized in that two or more discharge ports are arranged aligned in a vertical direction.

BEST MODE FOR CARRYING OUT THE INVENTION

Figure 3:
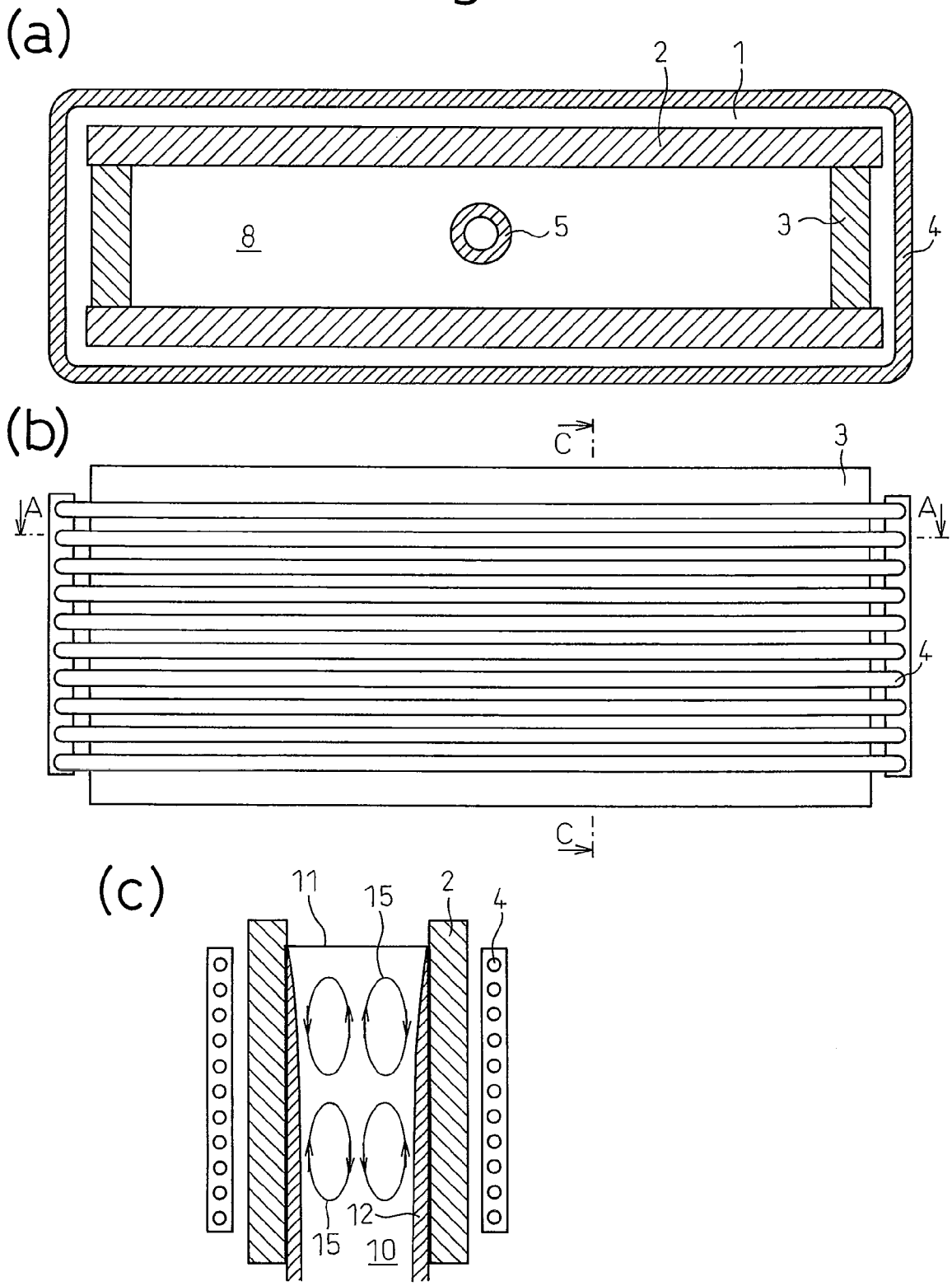
FIG. 3 gives views showing the relationship between the casting mold and the electromagnetic coil, wherein (a) is a cross-sectional view along the arrows A-A, (b) is a front view, and (c) is a cross-sectional view along the arrows C-C showing the rotary flow due to the electromagnetic force.

The present invention relates to a continuous casting method of molten metal. As shown in FIG. 3(*a*) and FIG. 1(*a*), molten metal 10 is injected into a casting mold 1 having a rectangular shaped cross-section casting space 8 through a submerged entry nozzle 5. The parts of the casting mold positioned at the long sides of the rectangular cross-section casting space 8 are called the "casting mold long sides 2", while the parts of the casting mold positioned at the short sides of the casting space 8 are called the "casting mold short sides 3".

The present invention, further, as shown in FIG. 3, arranges an electromagnetic coil 4 having an electric current path surrounding the casting space 8 around the casting mold 1. The thus arranged coil is called a "solenoid". By running an alternating current to this electromagnetic coil 4, the molten metal and solidified shell in the casting mold receive a pinch force oriented toward the center direction of the coil. The electromagnetic coil 4 is arranged at a position so that the molten metal near the meniscus in the casting mold receives a force in a direction separating it from the casting mold wall. Due to this, at the same time the molten metal near the meniscus in the casting mold receives a force in a direction separating it from the casting mold wall and makes the meniscus strongly bend, it is possible to enlarge the gap between the casting mold and the shell to promote the inflow of powder and lighten the oscillation marks to improve the shape of the cast slab surface.

By running an alternating current to the electromagnetic coil 4, the pinch force acts and simultaneously an electromagnetic induction flow is formed in the molten metal pool in the casting mold. The electromagnetic induction flow, as shown in FIG. 3(*c*), is formed at the center of the electromagnetic coil 4 in the height direction heading from the shell to the center of the molten metal pool and is divided at the pool center into the upward oriented flow and the downward oriented flow. At a location corresponding to the top half of the electromagnetic coil 4, a rotary flow 15 is formed comprised of an upward oriented flow at the pool center, an outwardly directed flow at the meniscus part, and a downward oriented flow near the shell. At a location corresponding to the bottom half of the electromagnetic coil 4, a rotary flow 15 is formed comprised of a downward oriented flow at the pool center, an outwardly directed flow at the bottom end of the electromagnetic coil, and an upward oriented flow near the shell.

Figure 1:
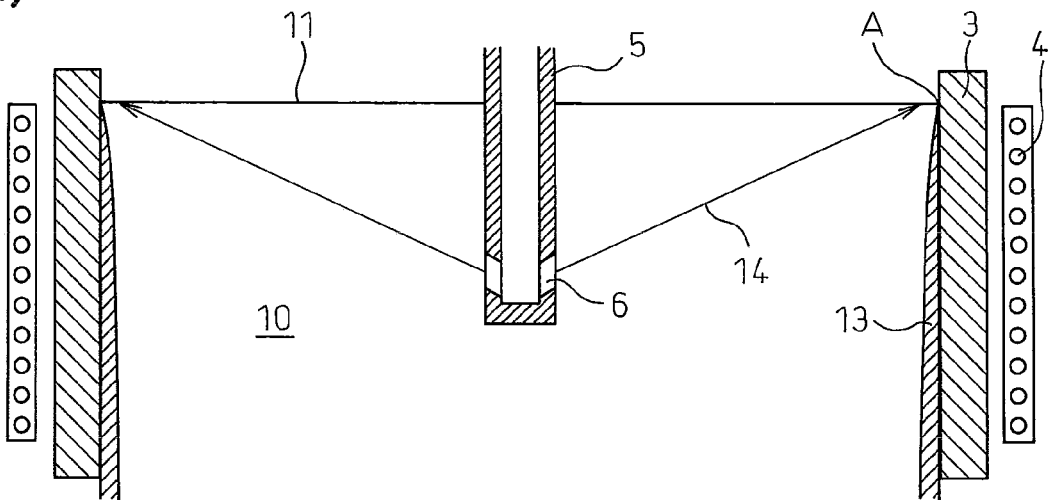
FIG. 1 gives cross-sectional views showing the state of the discharge flow in the casting mold, wherein (a) is a front cross-sectional view of the case with an electromagnetic force and (b) is a side cross-sectional view of the case with an electromagnetic force.
Figure 1:
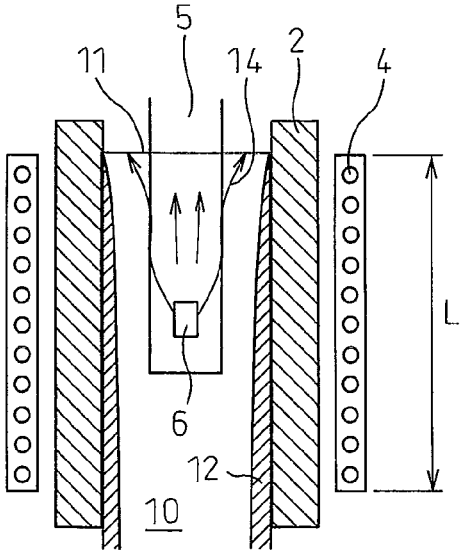
Figure 2:
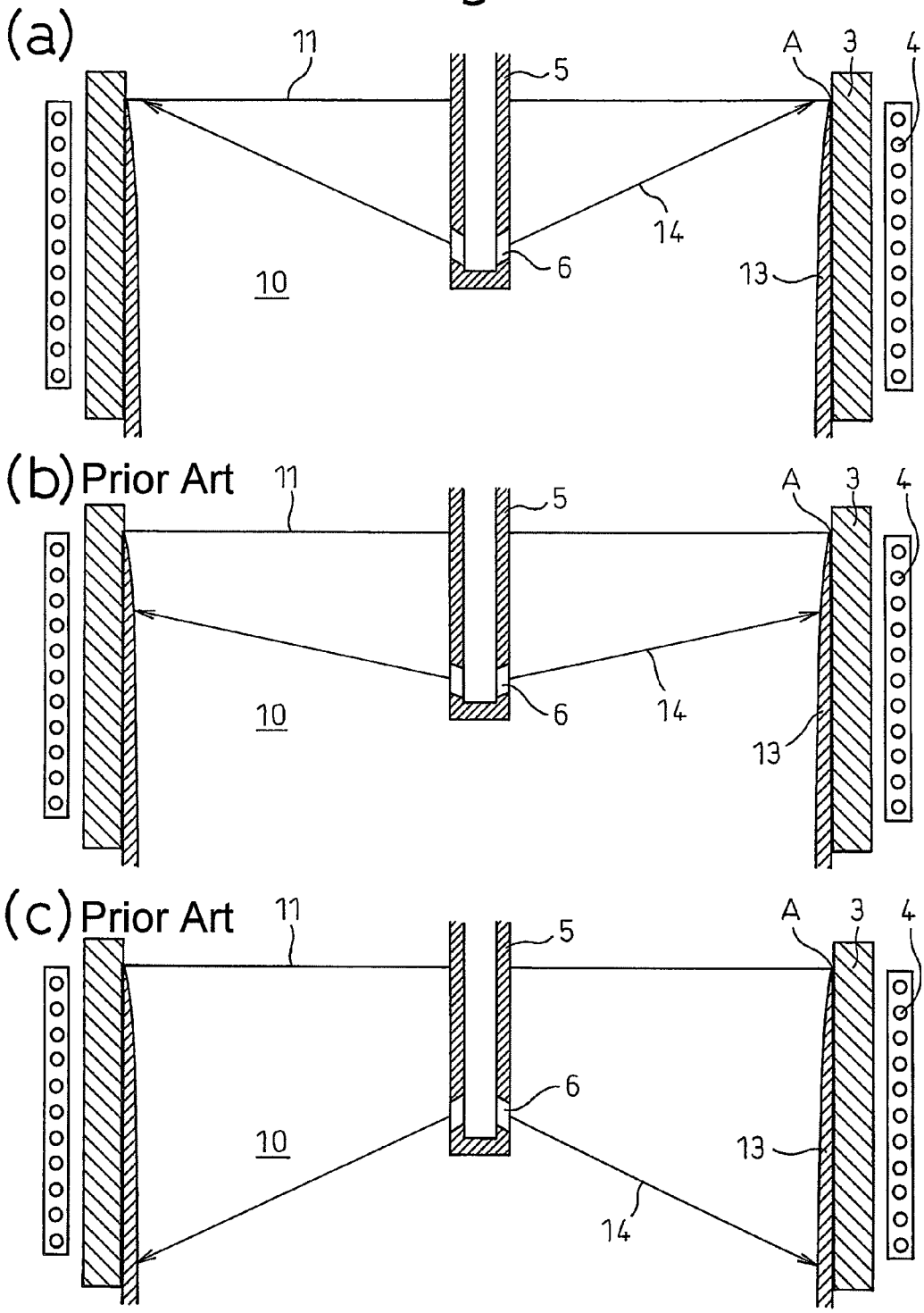
FIG. 2 is a front cross-sectional view showing the state of discharge flow in the casting mold for three different types of opening directions of the discharge ports.
Figure 4:
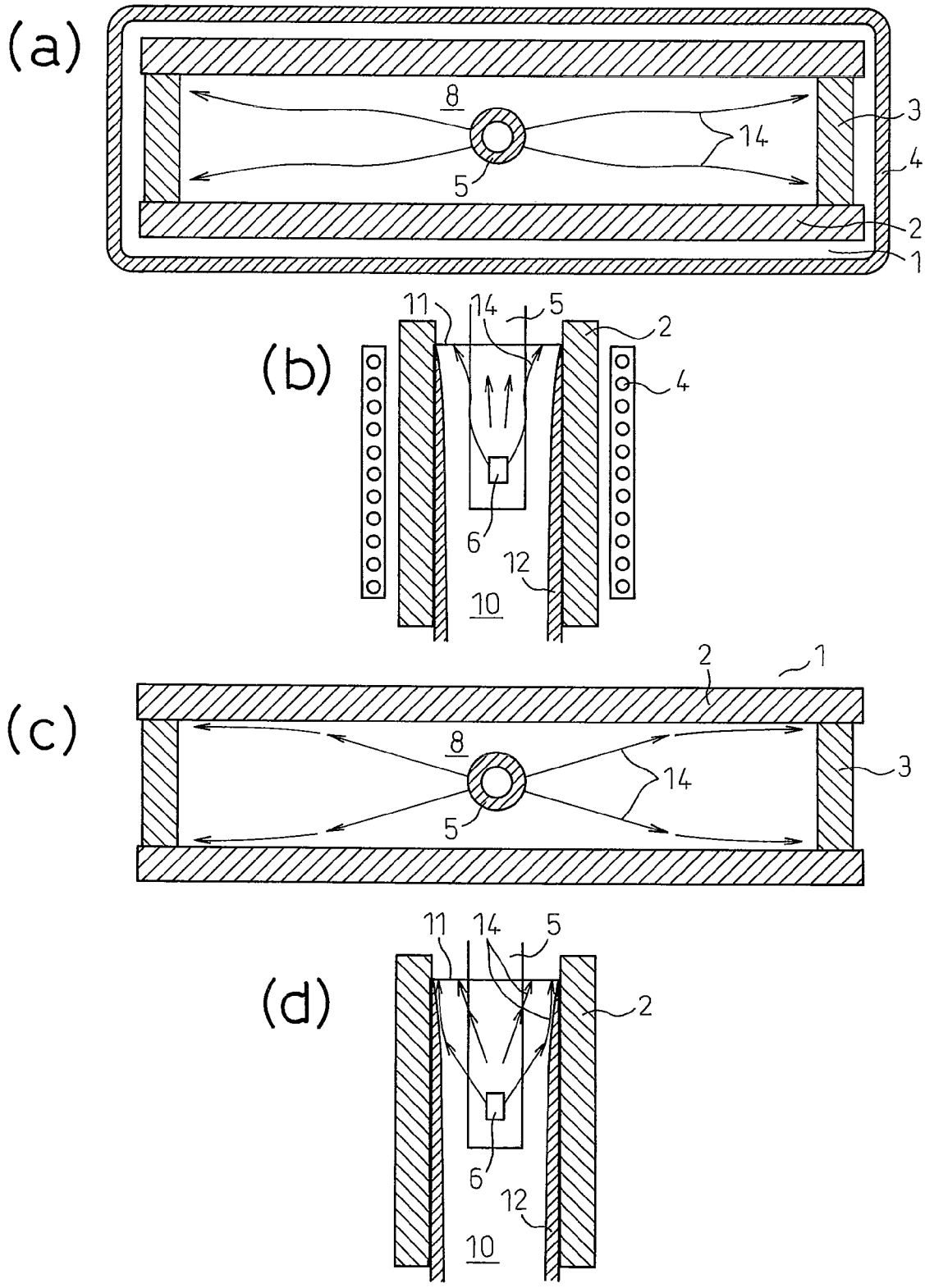
FIG. 4 gives views showing the state of the spread of the discharge flow in the width direction in the casting mold, wherein (a) and (b) are a planar cross-sectional view and side cross-sectional view of the case with electromagnetic force and (c) and (d) are a planar cross-sectional view and side cross-sectional view of the case with no electromagnetic force.

In the present invention, as shown in FIG. 1(*a*), the submerged entry nozzle 5 is characterized in that it has molten metal discharge ports 6 oriented in the width direction of the casting space and oriented upward from the horizontal and in that the direction of the discharge flow 14 from the discharge ports 6 is to above the intersection A of the casting mold short side and meniscus. Due to this, the discharge flow 14 reaches the meniscus 11 before striking the short side shell 13. As a result, the nonmetallic inclusions and bubbles in the discharge flow are absorbed at the continuous casting powder at the meniscus at the parts of the meniscus reached, so nonmetallic inclusions and bubbles will not be trapped at the short side shell 13 which the discharge flow 14 strikes like in the prior art shown in FIGS. 2(*b*) and (*c*). Further, the discharge flow 14 from the discharge ports 6 to the meniscus 11 receives the electromagnetic force due to the electromagnetic coil 4 and receives force from the long side shell toward cast slab center, so the spread of the discharge flow 14 in the cast slab thickness direction is suppressed and, as shown in FIG. 1(*b*) and FIG. 4(*a*) (*b*, the discharge flow 14 can reach the meniscus 11 without contacting the long side shell 12. Therefore, it is possible to keep nonmetallic inclusions and bubbles from the discharge flow 14 from being trapped at the long side shell 12. As a result, the electromagnetic force can be used to control the meniscus shape to improve the cast slab surface properties and simultaneously keep nonmetallic inclusions and bubbles from being trapped at the cast slab and thereby produce a cast slab excellent in both surface properties and internal quality.

Figure 5:
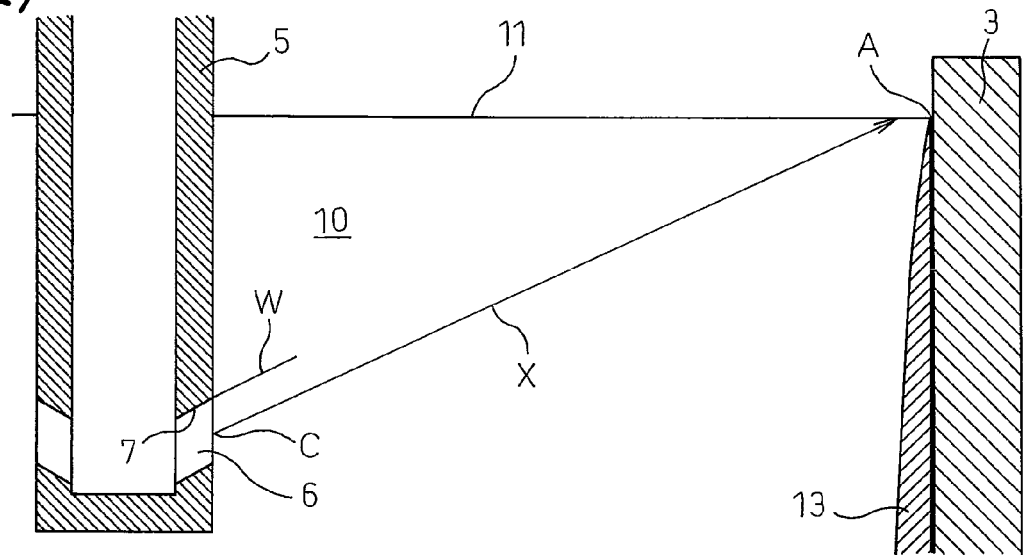
FIG. 5 is a view explaining the relationship between the shape of the discharge ports of the immersion nozzle and the discharge flow.
Figure 5:
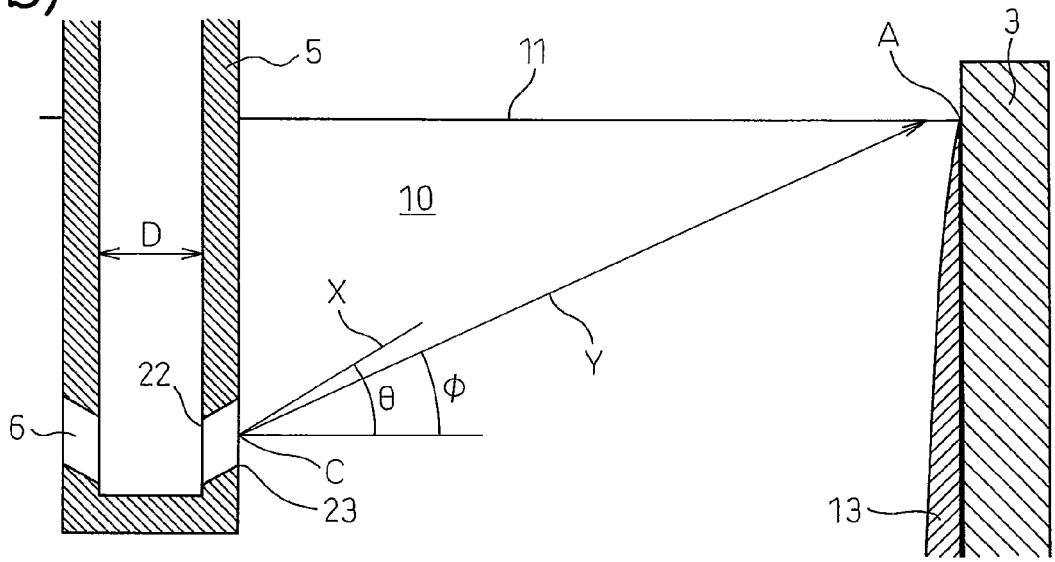

In the present invention, as shown in FIG. 5(*a*), the direction X of the opening of the discharge ports 6 heads above the intersection A of the casting mold short side and meniscus so it is possible to obtain the effect of the present invention. The "direction X of the opening of the discharge ports" means the direction W from the center C of the discharge ports 6 parallel to the inside circumferential wall of the discharge ports 7. When the inside circumferential wall has a cylindrical shape, this may be defined as the direction parallel to the inside circumferential wall. When the inside circumferential wall of the discharge ports is tapered, the direction of the axis of symmetry of the taper shape may be employed.

By defining the direction X of the opening of the discharge ports in the above way, it is possible to obtain the effect of the present invention. On the other hand, in actual continuous casting, the direction X of the opening of the discharge ports and the discharge direction of the discharge flow 14 sometimes do not match. Therefore, the inventors changed the discharge angle of the discharge ports of the submerged entry nozzle during continuous casting of steel given electromagnetic force in an actual machine to various angles and investigated the relationship between the direction X of the openings of the discharge ports and the direction of the actual discharge flow 14. Specifically, the inventors confirmed using sulfur as a tracer whether the discharge flow directly strikes the meniscus or strikes the shell of the casting mold short sides in the range of a linear speed of the discharge flow from the discharge ports of 0.5 to 2 m/sec. When sulfur is detected in the cast slab after casting, it can be judged that the discharge flow strikes the shell at the casting mold short sides, while when sulfur is not detected at the cast slab after casting, it can be judged that the discharge flow directly strikes the meniscus. As a result, it is learned that when having upward oriented discharge ports, the angle between the direction of the actual discharge flow and the horizontal direction becomes about 80% of the angle between the direction X of the opening of the discharge ports and the horizontal direction.

Therefore, the line Y is defined as shown in FIG. 5(*b*). The line Y passes through the center C of the discharge ports 6. The case is shown where the angle $\phi$ between the line Y and the horizontal direction is 0.8 of the angle $\theta$ between the opening direction X of the discharge ports and the horizontal direction. In the actual continuous casting, usually the direction of the discharge flow is in the range of 0.8 to 1 of the angle $\theta$ between the opening direction X of the discharge ports and the horizontal direction. In the present invention, as shown in FIG. 5(*b*), if the line Y is directed upward from the intersection A of the casting mold short side and meniscus, the direction of the discharge flow 14 can be made to reliably head above the intersection A of the casting mold short side and meniscus, so more preferable results can be obtained. At this time, 0.8 of the angle between the opening direction X of the discharge ports and horizontal direction is larger than the angle between the direction from the discharge ports center C to the intersection A of the casting mold short sides and meniscus and the horizontal direction.

Regarding the electromagnetic coil 4 having an electric current path around the casting mold surrounding the casting space 8, the casting direction length of the electromagnetic coil 4 is made "L". It is necessary that the alternating current flowing through the electromagnetic coil 4 cause the molten metal near the meniscus in the casting mold to receive a force in a direction separating it from the casting mold wall, so the top end position of the electromagnetic coil 4 becomes a position near the meniscus 11 in the casting mold.

The discharge ports 6 of the submerged entry nozzle 5 of the present invention are positioned are preferably positioned so that until the discharge flow 14 discharged from the discharge ports 6 reaches the meniscus 11, the discharge flow 14 continuously receives a pinch force from the electromagnetic coil 4 and the spread of the discharge flow 14 in the cast slab thickness direction is suppressed. Therefore, the casting direction position of the center of the discharge ports 6 is preferably above the bottom end position of the electromagnetic coil 4.

On the other hand, near the bottom end of the electromagnetic coil 4, a pinch force acts on the molten metal toward the center direction of the cast slab thickness, but, as shown in FIG. 3(*c*), the rotary flow 15 of molten metal due to the electromagnetic force becomes a flow from the center of cast slab thickness toward the surface layer. Therefore, to prevent the spread of the discharge flow 14, it is preferable to avoid a circulating flow heading toward this surface layer. The centers C of the discharge ports 6 are preferably positioned above the bottom end of the electromagnetic coil by more than ¼·L. Due to this, as shown in FIG. 1(*b*) and FIG. 4(*a*) (*b*), the discharge flow 14 discharged from the discharge ports 6 and reaching the meniscus 11 can be reliably kept from spreading in the cast slab thickness direction and the discharge flow 14 can be reliably prevented from contacting the long side shell 12 before reaching the meniscus 11. The centers C of the discharge ports 6 are more preferably positioned above the bottom end of the electromagnetic coil by more than ½·L.

Figure 6:
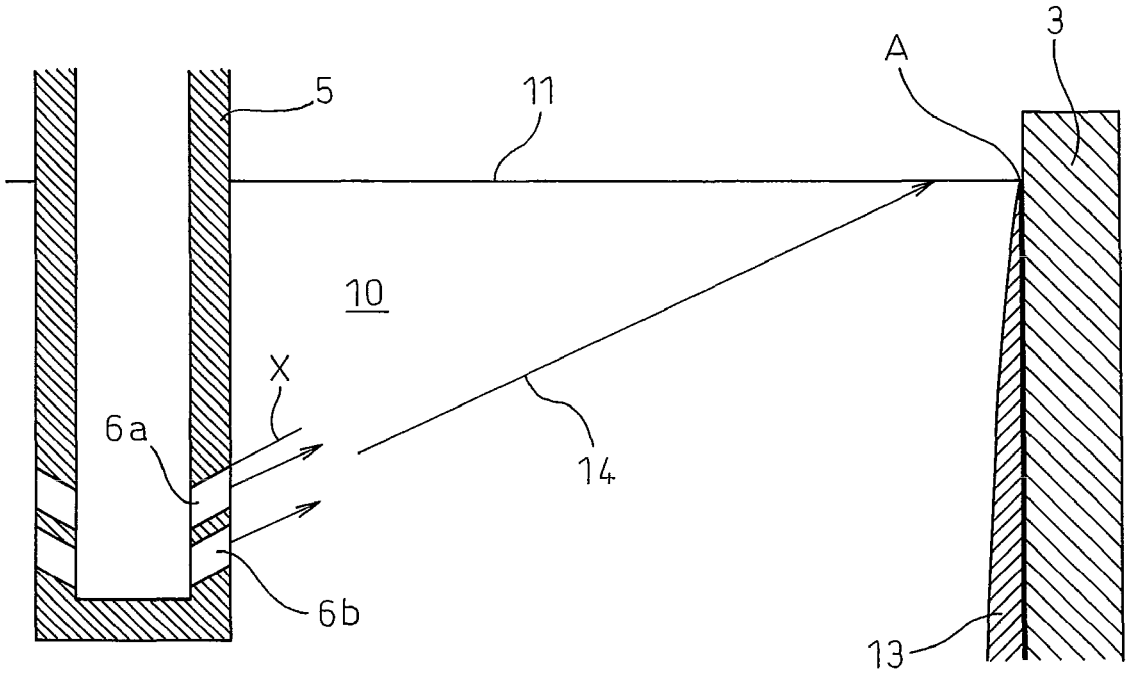
FIG. 6 is a view showing the case where there are two sets of discharge ports in the casting direction.

In the present invention, as shown in FIG. 6, it is preferable to arrange two or more discharge ports (6*a*, 6*b*) in the vertical direction (casting direction). Due to this, it is possible to reduce the cross-sectional areas of the openings of the individual discharge ports, so in the case of the same casting speed, it is possible to increase the linear speed of the molten steel from the discharge ports, so it is possible to make the direction of the discharge flow closer to the opening direction of the discharge ports. For this reason, it is possible to make the discharge flow reach the meniscus more reliably.

EXAMPLES

The present invention was applied in a continuous casting machine for casting a cast slab of a width of 1200 mm and a thickness of 250 mm in cross-sectional shape. The casting mold had a height of 900 mm, had a vertical part of 2.5 m right below the casting mold, and further had a bent part of a radius of curvature of 7.5 m and bent back horizontal part.

As shown in FIG. 3, an electromagnetic coil 4 having an electric current path surrounding the casting space 8 is arranged around the casting mold 1. This electromagnetic coil 4 has an alternating current run through it. The casting direction length L of the electromagnetic coil 4 is 300 mm. The top end position of the electromagnetic coil 4 is matched with the meniscus 11 position.

The submerged entry nozzle 5 has an outside diameter of 150 mm and an inside diameter of 90 mm. As shown in FIG. 1(*a*), near the bottom end, the submerged entry nozzle has discharge ports 6 oriented in the width direction of the casting space. The discharge ports 6 have an inside diameter (circle equivalent diameter) of 60 mm. The distance from the meniscus 11 to the discharge port centers C is 150 mm. There are two discharge ports 6. Discharge ports 6 of four types of opening directions X, that is, downward oriented 30 degrees, upward oriented 10 degrees, upward oriented 20 degrees, and upward oriented 30 degrees were prepared.

The inventors changed the conditions by the four types of opening directions X of the discharge ports 6, changed them further by presence or absence of electromagnetic force of the electromagnetic coil 4, cast low carbon Al-killed steel by a casting speed of 1.5 m/min, and evaluated the quality of the cast slabs. Conditions of no electromagnetic force and discharge ports of a downward oriented 30 degrees were used as reference conditions.

For discharge ports of an upward oriented 30 degrees, the opening directions X of the discharge ports, the direction of the line Y, and the direction of the actual discharge flow 14 all reach the meniscus 11 before striking the short side shell 13. For an upward oriented 20 degrees, the opening directions X of the discharge ports directly reached the meniscus 11 and the direction of the line Y was a direction reaching just slightly above the intersection A of the casting mold short side and meniscus right near it, but the direction of the actual discharge flow 14 directly reached the meniscus 11 in the invention examples with electromagnetic force and struck the short side shell 13 in the comparative examples without electromagnetic force. On the other hand, for discharge ports of an upward oriented 10 degrees and a downward oriented 30 degrees, the opening directions X of the discharge ports, the direction of the line Y, and the direction of the actual discharge flow 14 all directly struck the short side shell 13.

For the cast slab surface properties, the roughness of the surface was measured by a laser displacement meter. A total of five lines were selected: at 50 mm positions from the two short sides with respect to the width of the cast slab and at ¼ width, ½ width, and ¾ width. The surface relief of the cast slab surface was measured over a 200 mm length in the casting direction while moving the laser displacement meter with a spot diameter of 0.2 mm at a 0.2 mm pitch. The difference between the maximum displacement and minimum displacement for each 10 mm length on each line was obtained. This was compared over the total length. The maximum value was defined as the roughness degree. Further, the relative roughness degree indexed to the roughness degree of a sample of the reference production conditions as "1" was made the final definition.

Regarding the internal quality due to the nonmetallic inclusions and bubbles, the states of formation of surface layer inclusion and bubble defects and internal inclusion and bubble defects were evaluated. The "surface layer" is a depth of 20 mm from the cast slab surface and substantially corresponds to the thickness of solidification within the casting mold. The "internal" is the depth up to 20 mm to 50 mm depth of the casting surface layer and is a region including the part of the bent part forming a defective zone in a vertical bending continuous casting machine. For the surface layer, the entire width of the cast slab was milled over a 200 mm length in the casting direction at a 1 mm pitch in the thickness direction and the numbers of inclusions and bubbles were visually counted. For the inside, the entire width was milled over a 1 mm length in the casting direction at a 5 mm pitch in the thickness direction and the numbers of inclusions and bubbles were visually counted. For both, relative number indexes indexed to the number index of the sample of the reference production conditions as "1" was made the final definition.

TABLE 1

| | Electromagnetic force | Nozzle angle | Striking position of X | Striking position of y | Striking position of discharge flow | Discharge flow long side contact | Cast slab surface roughness degree index | Surface layer inclusion/ bubble defect number index | Internal inclusion/ bubble defect number index |
|---|---|---|---|---|---|---|---|---|---|
| Comp. ex. | No | Downward oriented | Short side | Short side | Short side shell | Yes | 1 | 1 | 1 |
| Comp. ex. | Yes | 30 degrees | shell | shell | | Yes | 0.1 | 0.6 | 0.5 |
| Comp. ex. | No | Downward oriented | Short side | Short side | Short side shell | Yes | 1.2 | 0.7 | 0.6 |
| Comp. ex. | Yes | 10 degrees | shell | shell | | No | 0.2 | 0.5 | 0.3 |
| Comp. ex. | No | Upward oriented | Meniscus | Just slightly | Short side shell | Yes | 1.25 | 0.5 | 0.4 |
| Inv. ex. | Yes | 20 degrees | | higher than intersec-tion A | Meniscus | No | 0.2 | 0.4 | 0.2 |
| Comp. ex. | No | Upward oriented | Meniscus | Meniscus | Meniscus | Yes | 1.3 | 0.3 | 0.3 |
| Inv. ex. | Yes | 30 degrees | | | | No | 0.2 | 0.1 | 0.1 |

The results are shown in Table 1. The invention examples with discharge ports upward oriented 30 degrees and electromagnetic force gave the best results in all of the cast slab surface roughness degree, surface layer bubble defects, and internal bubble defects compared with all of the comparative examples. The invention examples with discharge ports upward oriented 20 degrees and electromagnetic force also gave good results compared with the comparative examples.

Industrial Applicability

The present invention makes the discharge flow from the submerged entry nozzle discharge ports reach the meniscus without striking the short side shell and without contacting the long side shell either, so nonmetallic inclusions and bubbles can be kept from being trapped at the short side shell and the long side shell and the internal quality of the cast slab can be improved. Along with this, by running an alternating current through an electromagnetic coil arranged around the casting mold to surround the casting space to control the meniscus shape, the cast slab surface properties can be improved.

The invention claimed is:

1. A continuous casting method of molten metal, comprising:

injecting molten metal into a casting mold having a casting space of a rectangular cross-sectional shape through a submerged entry nozzle, arranging an electromagnetic coil having an electric current path surrounding the casting space around the casting mold, running an alternating current through this electromagnetic coil, and using said alternating current so that the molten metal near the meniscus in the casting mold receives force in a direction separating it from the casting mold wall while continuously casting the molten metal, said continuous casting method of molten metal characterized by forming a discharge flow discharged from discharge ports of molten metal provided at a front end of the submerged entry nozzle oriented upward from the horizontal toward the short sides of the casting mold and an intersection of a center line of the discharge flow/ports and the casting mold short sides is located above an intersection of the casting mold short sides and meniscus, wherein there is only one discharge port of molten metal toward one short side of the casting mold at the same height, wherein a casting direction length of the electromagnetic coil is made L and the center of the discharge ports is positioned above the bottom end of the electromagnetic coil by more than ¼·L.

2. A continuous casting method of molten metal, comprising:

injecting molten metal into a casting mold having a casting space of a rectangular cross-sectional shape through a submerged entry nozzle, arranging an electromagnetic coil having an electric current path surrounding the casting space around the casting mold, running an alternating current through this electromagnetic coil, and using said alternating current so that the molten metal near the meniscus in the casting mold receives force in a direction separating it from the casting mold wall while continuously casting the molten metal, said continuous casting method of molten metal characterized by providing discharge ports of molten metal provided at a front end of the submerged entry nozzle oriented upward from the horizontal toward the short sides of the casting mold and an intersection of a center line of the discharge flow/ports and the casting mold short sides is located above an intersection of the casting mold short sides and meniscus, wherein there is only one discharge port of molten metal toward one short side of the casting mold at the same height, wherein a casting direction length of the electromagnetic coil is made L and the center of the discharge ports is positioned above the bottom end of the electromagnetic coil by more than ¼·L.

3. A continuous casting method of molten metal as set forth in claim 1 or 2 characterized in that 0.8 of an angle between an opening direction X of said discharge ports and the horizontal direction is larger than an angle between a direction from the discharge port center C to the intersection A of the casting mold short side and meniscus and the horizontal direction.

4. A continuous casting method of molten metal as set forth in claim 1 or 2 characterized in that two or more discharge ports are arranged aligned in a vertical direction.

* * * * *